US006041453A

United States Patent [19]

Barrow et al.

[11] Patent Number: 6,041,453

[45] **Date of Patent: *Mar. 28, 2000**

[54] JET DIRECTED POOL SKIMMER WITH DIVERTER VALVE

[75] Inventors: Warren J. Barrow, 7329 Antietam Ct. West, Winter Park, Fla. 32714; Michael L. Schuman, El Monte, Calif.

[73] Assignee: Warren J. Barrow, Winter Park, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,013

[22] PCT Filed: Jan. 6, 1995

[86] PCT No.: PCT/US95/00188

§ 371 Date: Sep. 4, 1997

§ 102(e) Date: Sep. 4, 1997

[87] PCT Pub. No.: WO96/20772

PCT Pub. Date: Jul. 11, 1996

[51] Int. Cl.[7] ..... E04H 4/16

[52] U.S. Cl. ..... 4/496; 210/169; 137/115.13

[58] Field of Search ..... 4/490, 496; 137/115.13, 137/115.26, 118.06; 210/169

[56] References Cited

U.S. PATENT DOCUMENTS

| | | | |
|---|---|---|---|
| 2,536,663 | 1/1951 | Schaer | 137/115.13 X |
| 3,307,568 | 3/1967 | Gartner | 137/115.26 |
| 3,860,518 | 1/1975 | Henricksen | 4/490 X |
| 4,053,412 | 10/1977 | Stix | 210/169 |
| 4,305,830 | 12/1981 | Shimura | 210/923 X |
| 4,889,622 | 12/1989 | Newcombe-Bond | 4/490 X |
| 4,904,379 | 2/1990 | Ward | 4/490 X |
| 5,264,122 | 11/1993 | Lakotish | 4/490 X |
| 5,279,728 | 1/1994 | Weiss | 4/490 X |

*Primary Examiner*—Robert M. Fetsuga
*Attorney, Agent, or Firm*—Christie, Parker & Hale, LLP

[57] ABSTRACT

A debris skimmer (10, 91) is designed to float adjacent the surface of a pool (14) to entrap floating debris including leaves (99). The skimmer defines a floway (20, 180) having a front (18) and a rear (28), with an entrance lip (36) at the front, and a receptacle receiver (30) at the rear. This novel floway is bounded by side members (24, 26) and one or more holes (40, 80, 107) are utilized in a manifold (38, 78, 106) located in the vicinity of the entrance lip such that at least one rearwardly-directed jet of water can be supplied to the floway. This jet of water serves to establish a rearward flow of water through the floway, such rearward flow of water serving to carry floating debris toward the receptacle receiver means (30) located at the rear of the skimmer. The jet or jets of water may be supplied from a common manifold (38) extending along the underside of the entrance lip, or the jet or jets of water may be supplied from a manifold (78, 106) extending from side to side in an elevated position above the entrance lip. In each instance the manifold is adapted to be connected to a supply of water, preferably to the return line (46) of the pool. In this way the skimmer can function to remove floating debris such as leaves from the surface of a pool without entailing any operating expense over and above the usual expense for operating the pool.

14 Claims, 12 Drawing Sheets

JET DIRECTED POOL SKIMMER WITH DIVERTER VALVE

BACKGROUND OF THE INVENTION

1. Field of the Invention

This invention relates to apparatus for removing floating debris from the surface of a pool of liquid, and more particularly to a device utilized on the surface of the water of a swimming pool that serves to actively remove floating leaves, bugs and other debris.

2. Description of Problem Addressed and the Prior Art

Leaves and other floating debris are commonly removed from swimming pools by "skimmers" built into the walls of the pool at the normal water level. Wave action in the pool, generated by people using the pool and/or by the wind, is supposed to wash the floating leaves, etc. into troughs or openings in the wall of the pool, from whence they are drawn by a line connected to the suction side of the swimming pool pump. This system is less than satisfactory, particularly where the wind tends to blow floating leaves and debris against the pool walls at locations remote from the skimmer. Also, fluctuations in the water level adversely affect the operation of such fixed skimmers, even to the point of such skimmers becoming inoperative when the water level rises or falls even two or three inches. Further, it is not unknown that a built-in pool skimmer will have been placed in the pool wall at a location which is poorly placed relative to the overall circulation pattern established in the pool when the pool circulation system, of which that skimmer is a part, is operated. In all of such instances, a further skimmer elsewhere in the pool will be beneficial.

Attempts have been made to cope with fluctuations in the water level of the pool by devices such as that shown in U.S. Pat. No. 3,268,079 to Sharrow, Jr. wherein the skimmer unit floats in the water and hence always remains at the same position relative to the pool surface, even though the skimmer intake unit moves up and down with changes in the water level. These devices do not move about the pool, but rather are tethered in one place as shown in the Sharrow, Jr. patent.

U.S. Pat. No. 2,989,185 to Lombardi illustrates a skimmer which floats on the surface of the water and which utilizes a depending open mesh bag into which the floating leaves and debris are propelled downwardly by a jet of water. The Lombardi device moves over the surface of the swimming pool solely under the influence of air currents.

The U.S. Pat. No. 4,053,412 to Stix teaches the use of a floating skimmer that is anchored at a location adjacent one wall of the pool, with it being the intent of that device to trap debris carried around the pool by currents, such as those occurring near the water inlet near the upper portion of the wall. The Stix device stays in the location in which it is held by the submerged anchor, and it has no means of its own for creating any currents that would bring leaves into the inlet of the device.

The Sermons U.S. Pat. No. 4,089,074 entitled "Leaf Skimmer for Pools" is another floating skimmer, but it differs by being tethered alongside a drain of the pool, with this device likewise having no means for creating currents of its own, being limited to gathering the debris brought to it by the currents established in the pool.

It has been proposed to float the skimmer unit in the pool water, and move the skimmer unit over the surface of the pool in such a manner that it eventually covers the entire surface and thus is much more likely to pick up floating leaves and debris. An example of this approach is found in U.S. Pat. No. 4,105,557 to Weatherholt wherein a flat, platter-shaped floating housing has a mesh bottom and is dragged around the pool behind a conventional pool cleaner having a plurality of flexible whips or tentacles. The range and character of movement of the Weatherholt skimmer, as well as its capacity for holding debris, is extremely limited.

The Drew U.S. Pat. No. 4,746,424 entitled "Floating Swimming Pool Skimmer" teaches a floating swimming pool skimmer that is propelled randomly around the surface of a swimming pool, and because it has at least three inlet channels, floating debris can pass into the central collection area of the device through at least one of the channels, irrespective of the direction of motion of the device about the surface of the pool. This device is large and because of its complexity, it necessarily is quite expensive to manufacture and to maintain.

The Newcombe-Bond U.S. Pat. No. 4,889,622 utilizes a floating skimmer, but it necessitates the use of a submerged suction cleaner arranged to move randomly around the bottom of a pool. The suction cleaner is a powered device, that is attached to the floating skimmer by a line that may be wholly or partially elastic. No means are utilized for attracting floating leaves or other debris into the skimmer, so debris pickup from the surface of the pool is strictly by chance.

A patent not related to the removal of leaves and other debris from a swimming pool but nevertheless of some consequence to this invention is the Shimura U.S. Pat. No. 4,305,830 entitled "Water Surface Cleaner, Method and Apparatus," which issued Dec. 15, 1981. The Shimura device was clearly designed for the suctioning of non-solid flotage such as oil from the surface of a body of water, and instead of being powered by water from the return line of a swimming pool, the Shimura design manifestly relies upon the use of a pump and an expensive electric motor in his skimmer, as well as a suitable electric power source for the pump. As is obvious, the battery or batteries utilized by Shimura will necessarily need recharging or replacement from time to time.

A significant structural difference of the present invention over the device of the Shimura patent is the physical configuration of the present invention, wherein a substantially flat surface extending the length of the floway is provided for transporting solid debris such as leaves, twigs, trash and the like from the floway entrance rearwardly to an open mesh bag utilized at the rear end of the floway. In contrast, the Shimura device involves an entrance surface sloping downwardly at a steep angle, rather than utilizing a substantially flat, continuous surface.

The sharply descending inner front surface of Shimura is such as to cause water and oil entering the Shimura device to move steeply downwardly so as to enter the suction port for his pump 9, with the suction port for the pump and the associated filter being provided an intermediate floor 25.

It was in an effort to improve upon these and other such devices that the present invention was designed.

SUMMARY OF THE INVENTION

A solid debris skimmer or other debris collector in accordance with this invention is designed to float adjacent the surface of a pool, and to actively serve to entrap floating solid debris, such as leaves, twigs, bugs and the like. The upper surface of this novel debris skimmer or debris collector is configured to define a floway having a front and a rear, with an entrance lip located at the front of the device. The floway is bounded by side members, with a receptacle-receiving means located at the rear. Quite advantageously, means are utilized that are operative in the vicinity of the entrance lip defining at least one rearwardly-directed jet of water, but preferably utilizing a number of rearwardly-directed jets. These jets serve to create a distinct flow of water along the floway, which causes leaves and other floating debris to be directed rearwardly toward a receptacle supported by the receptacle-receiving means. The receptacle may be an open mesh bag that is maintained in clear view, thus enabling the pool owner to readily ascertain when the bag is full of leaves or other solid debris, and ready to be emptied.

In accordance with one embodiment of this invention, the means operative in the vicinity of the entrance lip for directing water rearwardly involves a series of rearwardly-directed holes connected to a common manifold extending along the underside of the entrance lip for substantially its entire width. A hose fitting is attached to the manifold, so that water under sufficient pressure to adequately power the jets may be readily supplied to the manifold from a remote location. The source of this water pressure is preferably the return line of the pool, which the pool builder establishes in order that filtered water can be circulated throughout the pool by the electrically-powered circulation pump. That pump is outside the pool and is an important component of the usual system for circulating water from the pool (commonly via the built-in skimmer), through a filter, and back to the pool via one or more return lines. This arrangement means that this novel skimmer is rendered active for effectively directing leaves into the leaf-gathering receptacle at all times that the circulation pump of the pool is running.

It has been found that this novel device functions best when the floway is positioned slightly under the surface of the water in the pool, and to this end, side members containing floatation means are utilized for holding this novel device at a suitable depth and attitude in the pool.

This invention is not to be limited to the use of a manifold located below the entrance lip, for in accordance with other embodiments, the manifold may be in an elevated position above the entrance lip, with this manifold or spray bar containing a spaced series of rearwardly-directed holes through which jets of water may flow under sufficient pressure as to induce a rearward flow of water through the floway. In one of these embodiments involving the manifold located above the surface of the water, the manifold or spray bar is rotatable for a number of degrees, so as to enable the user to control the reaction force created by the jets of water. In this way the user has some control over the trim of the skimmer as it floats on the surface of the pool, and hence some control over the positioning of the entrance lip.

It is thus to be seen that a primary object of this invention is to provide a floating debris skimmer of simple yet highly effective design, that serves to automatically and actively collect leaves, twigs and other solid debris from the surface of a pool, before the leaves can become waterlogged and sink to the bottom of the pool.

It is another object of this invention to provide a low cost floating skimmer for a pool that automatically functions in an active manner for leaf removal, but that advantageously does not involve the use of electric power within the pool itself and particularly not as a part of the skimmer, nor require any infusion into the pool of unwanted additional water in order for the device to be rendered operational.

It is still another object of this invention to provide a pool skimmer having a floway over which a distinct flow of water is caused to take place, such that leaves, bugs, twigs and other solid debris floating in a capture area in front of the skimmer are induced to enter the floway, and to be carried to the rear of the device, where such unwanted items are trapped in a suitable receptacle, such as a mesh bag or the like, from which the leaves can be readily removed.

It is yet another object of this invention to provide a floating pool skimmer having a floway equipped with an entrance adjacent which are utilized a plurality of jets powered from the filtered water being returned to the pool by the circulation pump, with these jets inducing a flow of water through the floway, such that leaves and other debris floating in the general vicinity of the device are caused to enter the floway, and to be carried rearwardly into a suitable receptacle that can be readily emptied when full.

It is yet still another object of this invention to provide a floating debris skimmer of low cost yet of highly efficient design, that functions automatically to effectively remove floating solid debris, such as leaves, and deposit such in an easily emptied receptacle, which device needs no expensive fittings to connect it to the filtered water being returned to the pool by the circulation pump, nor necessitate any maintenance expense.

It is yet still another object of this invention to provide a floating debris skimmer in combination with a flow limiting device serving to prevent an excess flow of water through the skimmer.

It is yet still another object of this invention to provide a floating debris skimmer in combination with a flow limiting device directly associated with the return line serving to deliver filtered water back into the pool, which flow limiting device functions to bypass excess water from the return line directly into the pool, rather than causing an excess quantity of water to flow through the skimmer.

It is yet still another object of this invention to provide a floating debris skimmer in combination with a flow limiting device directly associated with the return line serving to deliver filtered water back into the pool, which flow limiting device enables the user to select the direction in which the bypassed water is able to return to the pool, thus to enable a selected circulation pattern to be created in the pool.

It is yet still another object of this invention to provide an embodiment in which slidable weights are provided on an upper portion of this novel skimmer, enabling a user to adjust the trim at which the skimmer is disposed in the pool, and, thereby, the relationship of the floway to the surface of the water of the pool.

It is yet still another object of this invention to provide an embodiment in which extensible arms are utilized on the front of this skimmer, enabling the user to selectively expand the capture area that exists at the front of this novel device.

These and other objects, features and advantages will be more apparent from a study of the appended drawings and description.

BRIEF DESCRIPTION OF DRAWINGS

FIG. 1 is a perspective view showing the relationship of one embodiment of this novel debris skimmer to the sidewall of a pool in which it is being utilized, with this view also showing the manner in which water under pressure from a remote location, preferably originating in the circulation pump for the pool, is supplied to the front of the debris skimmer, to cause the rearward flow of water through the floway defined between the sidewalls of the skimmer, with the leaves and other solid debris carried by the rearward flow of water being retained in a mesh bag or the like;

FIG. 9 is a rear perspective view of the embodiment revealed in FIG. 8, with this view revealing the placement of holes in the elevated water manifold, and also revealing the receptacle means utilized on the rear of the device, for supporting a mesh bag or the like;

DETAILED DESCRIPTION

Figure 1:
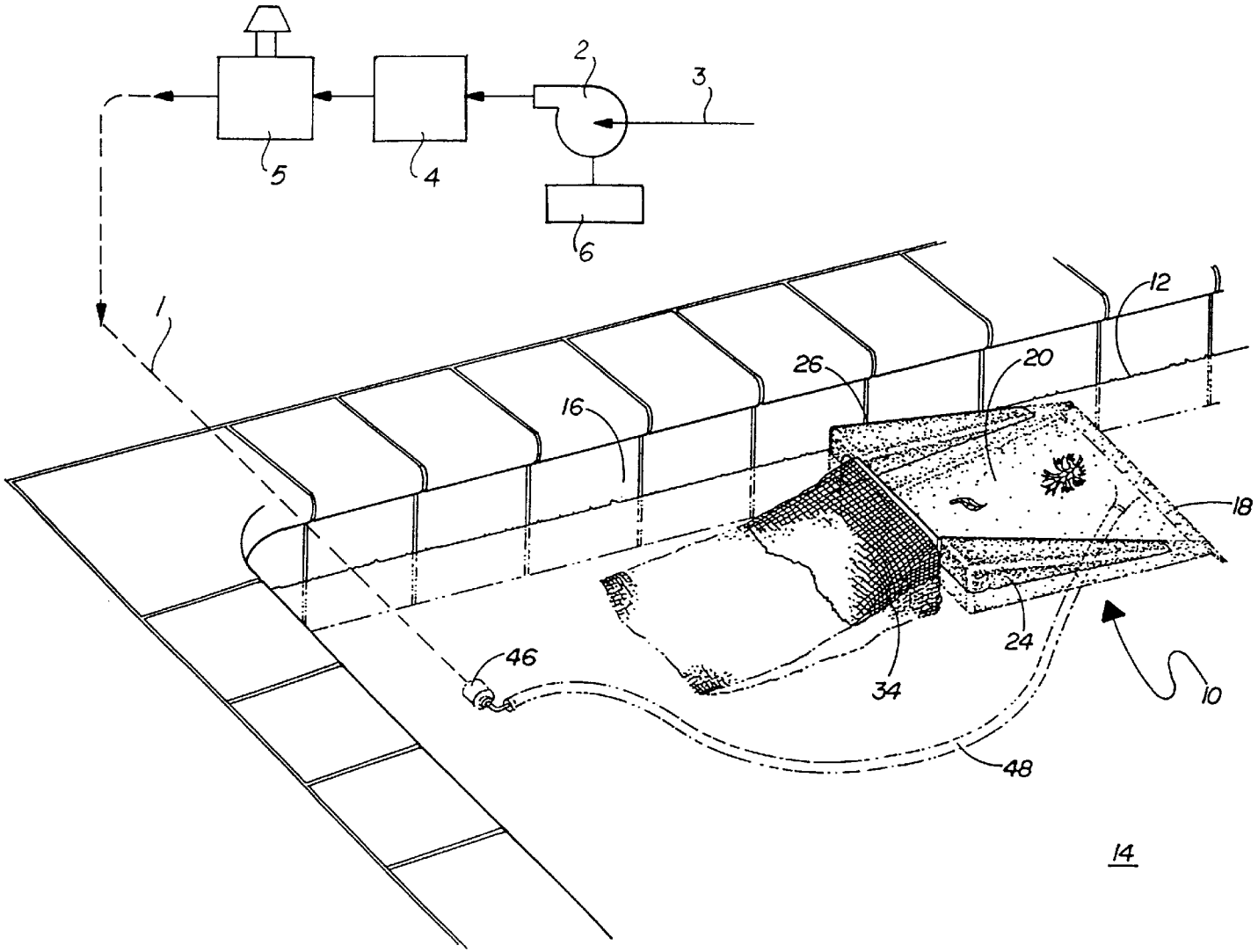

With initial reference to FIG. 1, it will be seen that a first embodiment of a debris skimmer 10 designed to float adjacent the surface 12 of a pool 14 is illustrated, which actively serves to entrap freshly-fallen leaves and other floating debris of a solid nature. This novel skimmer is preferably utilized closely adjacent a sidewall 16 of the pool, but this invention is not to be limited to this arrangement.

This novel debris skimmer or active debris collector 10 has a front edge 18 leading into a floway 20 defined between side members or sidewalls 24 and 26 of the skimmer. By means of jets of water directed rearwardly from the front of the debris skimmer, rearwardly flowing currents of water are caused to be established in the floway 20. These currents of water induce leaves and other floating solid debris to enter the front edge 18 of the skimmer, and to flow rearwardly through the floway 20, thus causing the leaves and other debris to be trapped in the open mesh bag 34 which is a preferred foraminous debris retaining receptacle in the skimmer. The leaves or other solid debris can be readily removed from the bag or receptacle 34 when the bag is seen to be substantially full.

It has been found that the jets of water emanating from a location adjacent the front of the skimmer are sufficient to cause a sizable flow of water into the front edge of the skimmer, such that a capture area is established on the surface of the pool in front of the skimmer. As a result, this skimmer may be regarded as actively serving to remove solid debris from the surface of a pool, utilizing non-electrical power.

Figure 2:
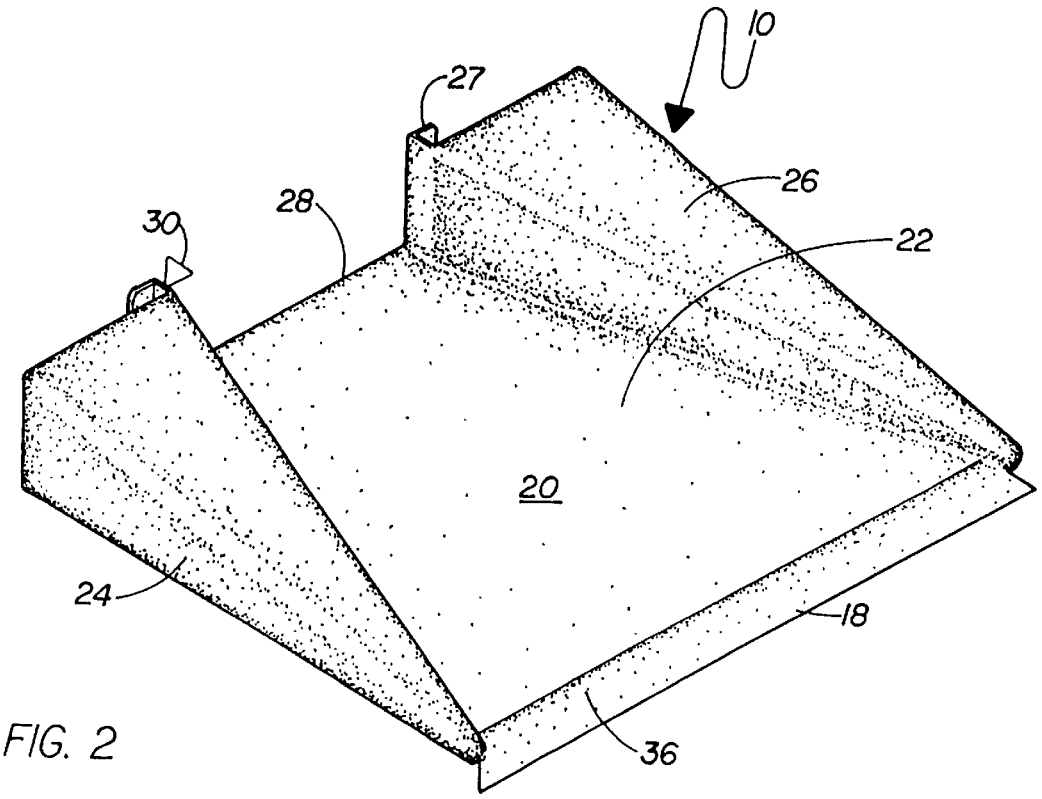
FIG. 2 is a front perspective view of the same embodiment of the debris skimmer, shown here having been removed from the environment of the pool, at the front of which skimmer are means for directing a flow of water rearwardly through the floway defined between the sidewalls of the skimmer, thus to carry leaves and other solid debris into a suitable leaf-receiving receptacle mounted at the rear of the device.
Figure 3:
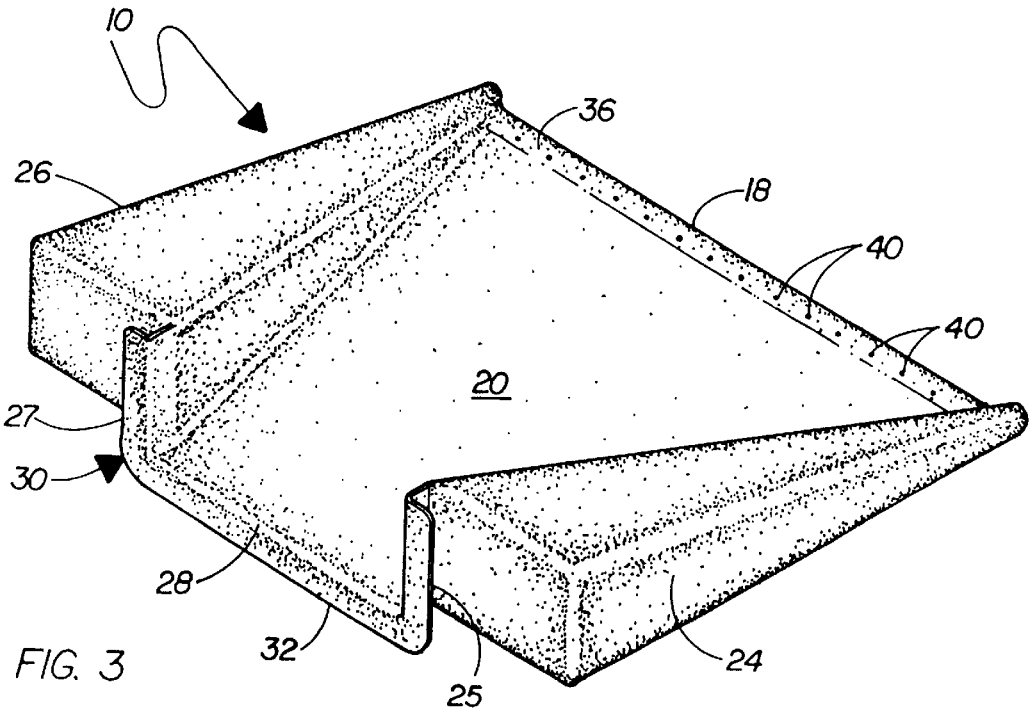
FIG. 3 is a perspective view of the embodiment depicted in FIG. 2 but in this instance being a view of the rear side of the skimmer, this view revealing the use of a series of rearwardly-directed holes located along the front edge of the debris skimmer, which holes, when supplied with water under pressure from a remote location, cause a distinctive rearward flow of water through the floway.

Reference is now made to FIGS. 2 and 3, wherein a first embodiment of the skimmer 10 is revealed, and it is here to be seen that the floway 20 has a substantially flat surface 22 that terminates in a rear edge 28. A receptacle-receiving means 30 is defined adjacent the rear edge 28, as most clearly visible in FIG. 3. The means 30 and the receptacle or bag 34 supported thereby will be discussed at greater length hereinafter.

With continued reference to the preferred embodiment of the invention depicted in FIGS. 2 and 3, it is to be understood that the front edge 18 of the novel debris skimmer involves an entrance lip 36, along the underside of which a manifold 38 extends for substantially the entire width of the entrance lip. A spaced series of holes 40 is located along the entrance lip 36, which holes are best seen in FIG. 3. It is from these holes in this preferred embodiment that jets of water from the manifold 38 may flow rearwardly under considerable pressure.

Figure 4:
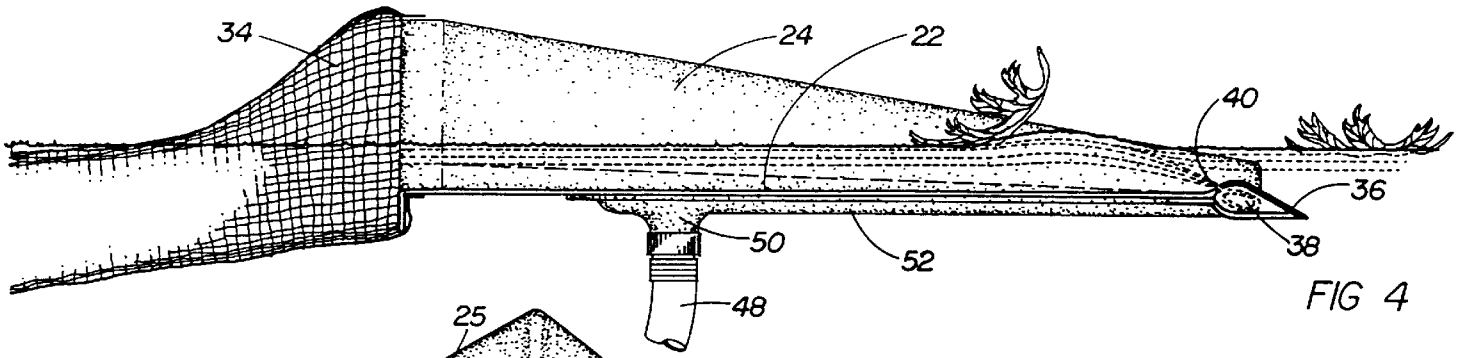
FIG. 4 is a side-elevational view, partly in section to reveal to a somewhat larger scale, the significant details of an embodiment in which the jets of water emanating from a series of rearwardly-directed holes located in the entrance lip of the skimmer cause a distinct, rearwardly-directed flow of water through the floway, carrying floating solid debris such as leaves rearwardly and causing them to enter a suitable receptacle, here a mesh bag.
Figure 5:
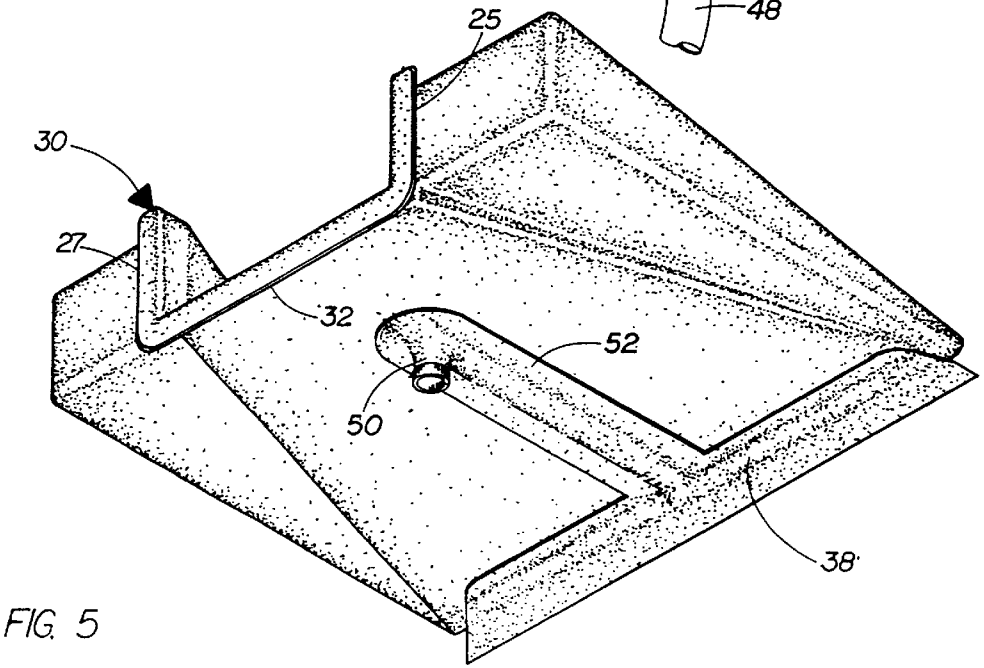
FIG. 5 is a perspective view of the underside of the preferred embodiment of the invention, here revealing the type of hose connection that may be utilized below a central portion of the skimmer.

The manifold 38 of this first embodiment of this invention is best seen in FIGS. 4 and 5. Although the manifold may be a separate component, such as a length of PVC tubing or the like that is secured along the underside of the entrance lip 36, it is preferred for the manifold 38 to be created as an integral part of the entrance lip 36, residing along the underside thereof.

The manifold 38 is to be connected to a source of water under pressure, and this source is typically the return line 1 of the pool, from which filtered water is being returned to the pool by the pool circulation pump 2. The pump receives water from the pool through a supply or suction duct 3 and discharges to a filter 4. The filter, in turn, discharges to a heater 5. Return line 1 routes water from the heater back to pool 14. The pump is driven by an electric motor 6. The pump is driven by an electric motor 6. The pump and its motor, the filter 4, and the heater 5 (if provided) are located outside the pool. A principal purpose of skimmer 10 is to collect from the pool surface large pieces of floating debris and so prevent that debris from entering filter 4, via duct 3 and pump 2, where its presence interferes with operation of the filter to extract small particles from the recirculating water stream.

As shown in FIGS. 1 and 4, a length of flexible hose 48 extends from an internally threaded fitting 46, provided on the lower sidewall 16 at the time the pool was being constructed. The particular hose connection preferred in this particular instance utilizes a nipple 47 threaded on both ends, but as will be seen hereinafter with regard to FIG. 10, instead of a hose, we may utilize a series of interconnected plastic pipes, preferably those of a flexible nature, with interconnecting fittings used at various locations.

Figure 4A:
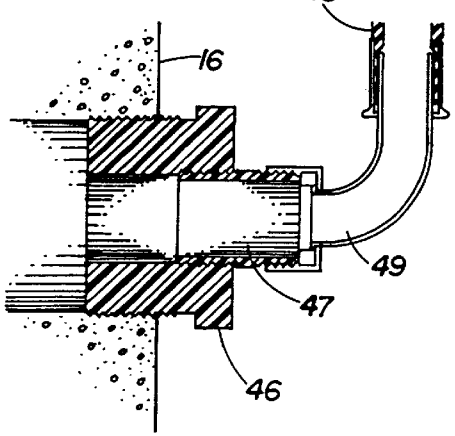
FIG. 4*a* is a cross-sectional view of one type of fitting utilized on the side of a pool, from which water is returned to the pool by the circulation pump customarily utilized for accomplishing a filtering of the pool water, with a hose being employed for connecting this fitting to the novel skimmer, for the supply of water under pressure thereto.

As best seen in FIG. 4*a,* the nipple 47 is threadedly connected into the fitting 46, so as to form a suitable connection for the flexible hose 48. The hose preferably involves the use of an elbow 49, so that the hose 48 will tend to reside relatively close to the sidewall of the pool; note FIG. 1.

With regard to the connection of the other end of the hose 48 to the skimmer 10, in FIGS. 4 and 5 a hose connection or fitting 50 on the underside of the skimmer is revealed. The fitting 50 may be located in a central portion of the underside, with water entering the fitting 50 being directed forwardly so as to emanate from the series of rearwardly-directed holes 40 located along the water manifold 38 provided at the front of the skimmer. FIG. 4 will be discussed at greater length hereinafter, and from a study of the embodiment revealed in FIG. 4, it will be apparent that this invention operates in a fully automatic, active manner to remove floating solid debris from the surface of a pool, accomplished without necessitating the use of any electrical power.

The skimmer 10 is preferably molded with the flat surface 22 being of one-piece construction with the side members 24 and 26, although it is possible to construct the flat surface 22 as a single entity, and thereafter secure the side members thereto.

When utilizing a construction in which the flat surface 22 is part of the side members of the skimmer, the fitting 50 is preferably attached to a preformed T-shaped member 52, best seen in FIG. 5. The preformed T-shaped member is in turn attached in sealed relation to a mid portion of the underside of the skimmer. It is to be noted that the T-shaped member 52 is molded so as to form a supply duct having somewhat of a U-shaped cross section. In other words, the forwardly-extending leg of member 52 has sufficient curvature as to define a duct or supply passage extending forwardly from the fitting 50 to the lower front edge of the skimmer. There this passage divides so as-to define the manifold 38 that extends to the left and to the right along the underside of the front edge of the skimmer.

With continued reference to this first embodiment of the skimmer of this invention, it is to be understood that means are operatively associated with the entrance lip 36 for directing water under substantial pressure from the manifold 38, rearwardly across the surface 22 of the floway 20. In this preferred embodiment, the means for directing one or more jets of water rearwardly across the floway 20 involves the previously-mentioned series of holes 40 connected to the water manifold 38.

As best seen in FIGS. 3 and 4, the plurality of holes 40 are directed essentially rearwardly, but preferably with a slight upward angularity in this embodiment; note FIG. 4 in particular. This arrangement serves to induce a distinct rearward flow of water along the surface 22 of the floway 20. This invention is not to be limited to the utilization of a plurality of holes for creating the flow of water across the floway, however, one or more rearwardly-directed, longitudinally-extending slots in the manifold 38 may be utilized for bringing about such rearward flow of water across floway 20.

With a sufficient amount of pressure in the water manifold 38, rearwardly-directed jets or sprays of water from the holes 40 are sufficient to cause a substantial flow of water over the surface 22 of the floway 20 in a rearward direction, with the result that a current of water is actively created in the pool adjacent the front of the debris skimmer 10. This rearward flow of water through the floway is such as to define currents of water in the pool, that are directed into the front of the skimmer, with this resulting in the creation of what is preferred to call the capture area.

As best revealed in FIG. 4, this current of water entering the front edge 18 of the device 10 moves along the length of the floway 20, and then exits from the rear edge 28, adjacent the receptacle-supporting means 30. As a consequence of the establishment of this current of water through the device 10, leaves and other such solid debris floating on the surface 12 of the pool that move into the capture area in the front of the device 10 are induced to enter the floway 20, pass the length of the floway 20, and then enter a suitable receptacle 34 supported by the receptacle-supporting means 30.

FIG. 3 reveals that the receptacle-receiving means 30 may take the form of a vertically-disposed flange 25 located at the rear of side member 24, and a vertically-disposed flange 27 located at the rear edge of side member 26, with those flanges joining with a similar flange 32 extending along the bottom of the rear edge 28 of the skimmer 10. In this way, these three components define a continuous groove or recess that forms a suitable receptacle-supporting means 30. Around this groove or recess, the open end of a leaf-receiving bag 34 or the like may be placed, and preferably held in place by an elastic. As an alternative, the open end of a leaf receiving bag may be held in place on the receptacle-receiving means 30 by a drawstring arrangement; note FIG. 13. Still other alternatives may be utilized within the spirit of this invention, as will be obvious to those skilled in this art.

It is preferred to utilize an open mesh bag 34 as the leaf-receiving receptacle, the open end of which bag is preferably fitted with an elastic or a drawstring, as previously mentioned, thus enabling the open end of the bag to be placed around the receptacle-receiving means 30 of the skimmer 10 in an easily removed manner. The bag 34 normally remains in a readily visible location, as is to be seen in FIGS. 1 and 4, so that the pool owner can readily ascertain when the bag is to be emptied. The closed end of the bag 34, that is, the end of the bag opposite the elastic, may be held together with Velcro so that after removal from the receptacle-receiving means 30, leaves may be readily emptied from the bag 34 by pulling apart the Velcro portions. After being emptied, the end equipped with the Velcro members is reclosed, and the open end of the bag 34 is then reinstalled upon the receptacle-receiving means 30.

In some instances it may be possible to dump the solid debris out of the bag without having to detach the bag from the skimmer. This of course may be accomplished by opening the location on the bag where the Velcro is used, and then lifting the skimmer so that the contents of the bag may be dumped into a suitable receptacle that is then removed from the pool area.

For reasons of economy, and for the avoidance of having to insert additional, unwanted water into the pool, it is preferred to supply the manifold 38 with water being returned to the pool by the return line provided by the builder of the pool, as previously made clear. By the return line it is intended to connote and refer to the filtered water being returned by the pool's circulation pump (not shown), which serves to circulate the water throughout the pool in a highly desirable manner. In case of circulation pump failure, a garden hose may be connected to the fitting located on the underside of the skimmer, such that operation of the skimmer by the use of city water can prevent a leaf buildup on the surface of the pool during the time that the circulation pump is being repaired. It is known that many leaves tend over period of time to become waterlogged, and sink to the bottom of the pool. Therefore, it is often quite desirable to maintain the highly advantageous action of the skimmer during any period in which the operation of the circulation pump of the pool is for any reason shut down.

It will be recalled that the previously-mentioned hose 48, discussed in conjunction with FIGS. 1, 4 and 4A, was utilized for supplying water under pressure to the series of holes 40. The flexible hose 48 used with this embodiment of this invention is of finite length, typically being something on the order of six feet, with the hose 48 thus preventing the debris skimmer 10 from moving too far away from a desired location along a sidewall 16 of the pool. It is preferred for either the outside edge of the side member 24, or the outside edge of the side member 26 to reside closely alongside a sidewall 16 of the pool.

Usually there is no need to utilize any particular securing means for causing the outer edge of either side member 24 or side member 26 to reside close to the sidewall of the pool, for typically the hose 48 is of sturdy construction, tending to remain in a preferred location near the adjacent pool sidewall. The action of the hose 48 in holding the skimmer 10 close to the pool sidewall can be enhanced by utilizing the previously-mentioned right angle fitting 49 on the end of the hose 48. The fitting 49 threadedly connects to the nipple 47 utilized in the customary fitting 46. In addition, it may be desirable to induce some "twist" into the hose 48, such that it will bias the adjacent side member of the skimmer against the near sidewall 16 of the pool. In certain installations it has been found that an ordinary washing machine hose, which has a female fitting at each end, may be effectively utilized as the flexible hose 48.

As indicated in the embodiment of this invention depicted in FIGS. 3 and 4, the water flowing out of the holes or slots in the manifold 38 possesses sufficient force as to create a rearwardly flowing current of water that is of sufficient intensity as to cause a capture area to be defined in the pool water at a location forward of the front edge 18 of the skimmer 10. This arrangement functions in an automatic, highly effective manner for inducing solid debris floating in the vicinity of the front edge 18 to enter the floway 20, to travel the length of the floway to the rear edge 28 of the device, and into a mesh bag 34 or other such receptacle. In other words, this device functions in quite an active manner to collect floating leaves as well as other solid debris from the surface of the pool, and is thus in contrast with prior art floating debris skimmers that functioned only in a passive manner to collect floating leaves, and in stark contrast with devices whose operation depends on the utilization of electrical power.

So that the active surface 22 of floway 20 will float slightly submerged, yet reside suitably close to the surface 12 of the water in the pool 14, the previously-mentioned side members 24 and 26 possess a desirable floatation characteristic, such that the active surface 22 of the skimmer 10 will float in a highly desirable relationship to the surface of the pool. This invention is not to be limited to any particular floatation arrangement, for the side members may either be in the form of hollow, watertight compartments, or, as an alternative, the side members 24 and 26 can contain a suitable floatation material, with the arrangement being such that the active surface 22 of the floway will reside at a desired depth in the pool.

The front edge 18 of this skimmer embodiment is typically to be maintained in a slightly submerged relationship to the surface 12 of the pool, so that there will be no hindrance to the entry of floating solid debris into the floway 20. This invention is not to be limited to any particular depth at which the surface 22 of the floway resides, but typically the surface of the floway operates approximately in the range of ¾ inches to 2 inches depth, with a depth of 1½ inches usually being preferred.

As to the positioning of the novel debris skimmer 10 in the pool, it is not necessary to place it in any fixed location, although the side members 24 and 26 are preferably configured in such a manner that one or the other of the sides of the skimmer can be in a touching relationship with the side of the pool, as previously mentioned. As a result of this close relationship, the front edge 18 can reside comparatively close to the side of the pool, thus to avoid a circumstance in which a leaf buildup could take place between an edge of the device and the sidewall of the pool. Also as previously mentioned, the hose 48 prevents the skimmer 10 from moving very far away from the desired operational position.

Figure 6:
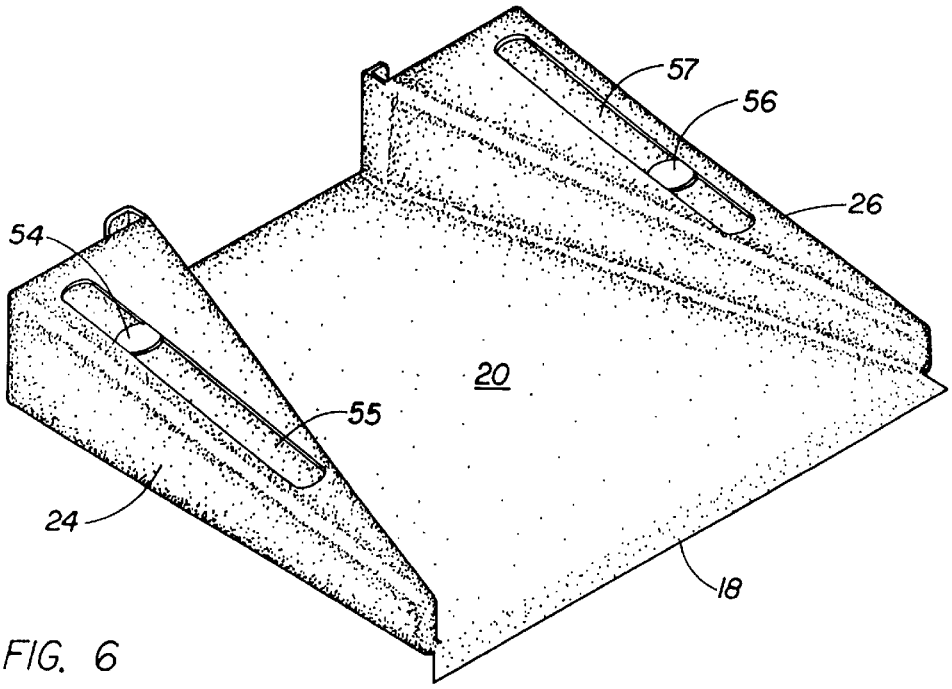
FIG. 6 is a front perspective view of another embodiment of the novel debris skimmer, revealing the utilization of slidably movable weights on the upper surface of each side member, which weights can be moved either forward or rearward by the user, so as to adjust the trim of the skimmer, that is, the positional relationship of the floway to the surface of the pool.

With reference to FIG. 6, this represents another embodiment of the novel debris skimmer, which in the interests of clarity is depicted without any arrangement for collecting leaves that have been encountered. In this figure is revealed the utilization of slidably movable weights 54 and 56, which are disposed in suitable slots 55 and 57, that are located on the upper surface of side members 24 and 26, respectively. Because of the slidable manner in which the weights 54 and 56 are mounted, these weights can be moved either forward or rearward by the user, so as to enable him or her to carefully adjust the trim of the skimmer. By this is meant that the weights 54 and 56 can be carefully positioned by the user, such that he or she is enabled to precisely adjust the angular relationship of the front of the floway to the surface of the pool.

By virtue of the slidably movable weights, and the construction of the side members 24 and 26 to either be hollow or to contain suitable floatation material, it is readily apparent that the user can carefully control the effective buoyancy distribution of the skimmer.

In many embodiments of our invention, the use of weights for trim adjustment will be seen to be entirely unnecessary. For example, and as will be seen in some detail hereinafter, the user can, in some embodiments, use a selective rotation of the spray bar in order to bring about a desired extent of trim control for the skimmer.

Figure 7:
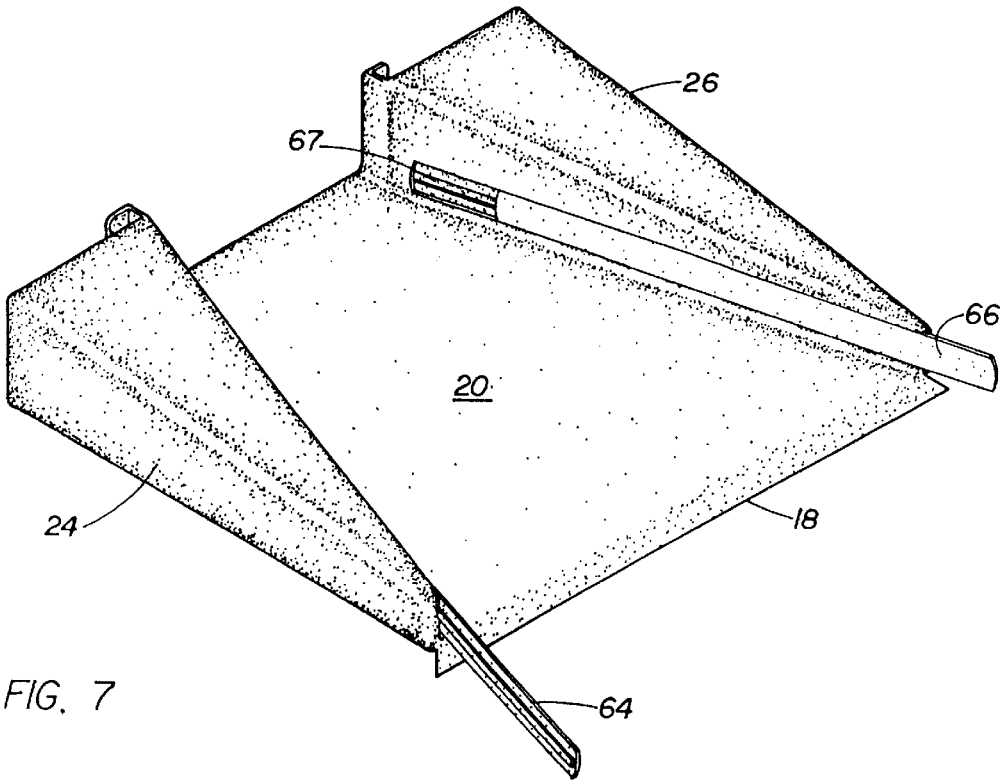
FIG. 7 is a front perspective view of still another embodiment of the novel debris skimmer, revealing the use of an extensible arm on each of the side members, one or both of which arms can be extended so as to increase the capture area of the debris skimmer.

FIG. 7 represents still another embodiment of the novel debris skimmer, from which the leaf-receiving bag has been omitted in the interests of clarity, with this figure revealing the use of an extensible elongate arm 64 slidably mounted on the interior surface of the side member 24, as well as an extensible elongate arm 66 slidably mounted on the interior surface of the side member 26. As will be obvious to those skilled in the art, either or both of these arms can be readily extended so as to increase the capture area in the front of the novel debris skimmer.

As visible in FIG. 7, the extensible arm 66 is operatively mounted in an elongate slot 67 located somewhat above the active surface 22 of the skimmer, with a similar slot (not shown) being provided in which extensible arm 64 is located. Sufficient friction is provided in the mounting arrangement for both arms, as will cause the arms to remain in the established relationship to the front edge 18 of the skimmer, but not so much friction is utilized as to make the selective movement of the arms 64 and 66 difficult.

When the novel skimmer 10 is utilized with one side member close to a sidewall of the pool, the extensible arm corresponding to that side member is normally retained in the non-extended relationship, whereas the extensible arm mounted on the opposite side member may be utilized in the extended position to increase the capture area. If the skimmer is not being utilized close to a sidewall of the pool, then the user may decide to extend both the arm 64 and the arm 66.

Figure 8:
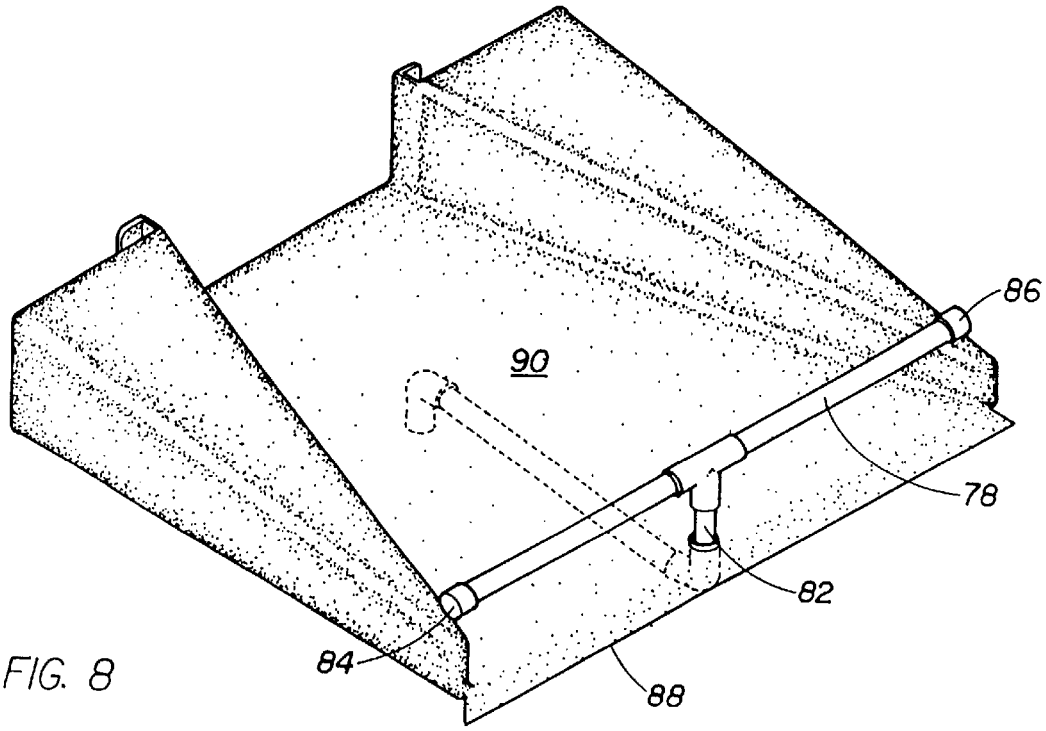
FIG. 8 is a front perspective view of yet another embodiment of the novel debris skimmer, revealing that the jets of water directed rearwardly from the front of the skimmer can emanate from a manifold or spray bar elevated somewhat above the floway defined between the side members.
Figure 9:
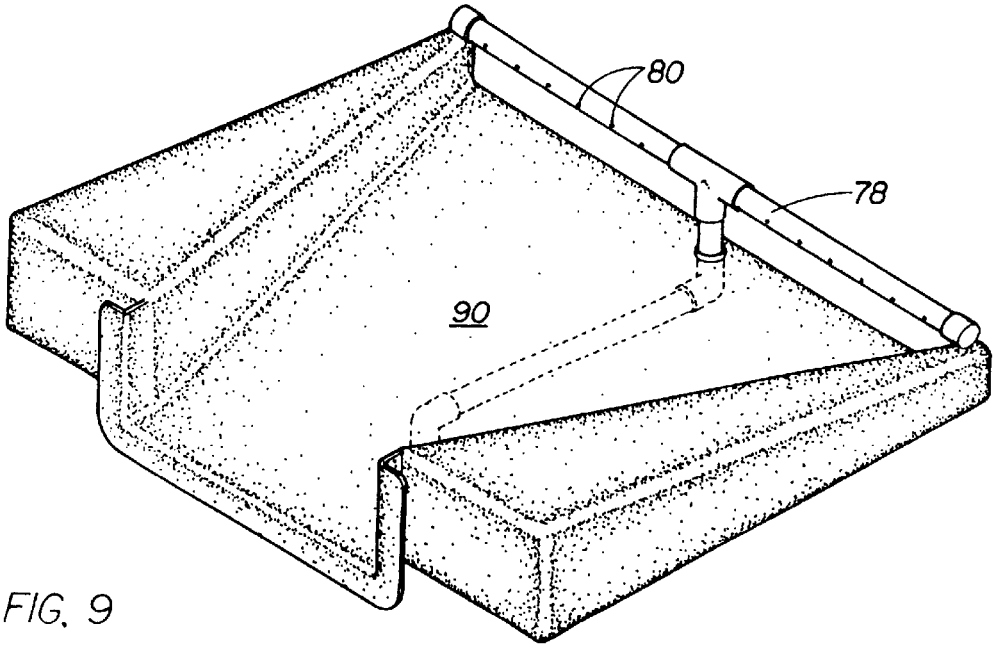

With reference now to FIGS. 8 and 9, wherein the leaf catching receptacle has been omitted in the interests of clarity, it is to be seen that these figures depict yet another embodiment of this novel debris skimmer. More particularly, these figures reveal that the jets of water directed rearwardly from the front of the skimmer can emanate from an elevated manifold or spray bar 78 that is located somewhat above the floway 90 defined between the side members. In this particular embodiment of an elevated spray bar, the manifold 78 is supported from a hollow member 82 that is preferably disposed at a central location adjacent the front edge 88 of the skimmer, with the ends of the manifold 78 being capped by members 84 and 86 to prevent the escape of water from undesired locations on the manifold 78. The members 84 and 86 may be located quite close to the upper front edges of the side members of the skimmer. We are not to be limited to this configuration, however, for as will hereinafter be seen in the embodiment in accordance with FIG. 10, the central member may be entirely omitted, and water conveyed to the elevated manifold from each side of the skimmer.

In FIGS. 8 and 9, the central support 82 as well as the manifold or spray bar 78 are typically made of PVC because of its lightness, durability and low cost. Although not shown in FIG. 8, it is to be understood that a suitable fitting, similar to the fitting 50 on the underside of the embodiment shown in FIG. 5, may be utilized for supplying water from the circulation pump of the pool to the pipe or supply duct extending across the bottom of the skimmer forwardly toward the front edge. This pipe or tube thereafter connects to the central support 82 such that water can be supplied to the elevated manifold 78. The fitting from which the hose is to be attached is preferably located on the longitudinal centerline of the skimmer, so as to minimize any undesirable tendency for the skimmer to be unbalanced.

As shown in FIG. 9, a spaced plurality of holes 80 are utilized on the rear side of the water manifold or spray bar, such that water under pressure supplied to the manifold 78 can be directed rearwardly along the floway 90 disposed between the side members of this embodiment of the novel skimmer. Whereas the holes 40 in the primary embodiment are preferably directed somewhat upwardly in addition to being directed rearwardly, the holes 80 in the manifold 78 are directed somewhat downwardly as well as rearwardly, so as to cause the jets of water to induce an optimum flow of water and items of solid debris through the floway 90 of this embodiment.

As should now be apparent, a low cost yet highly effective debris skimmer has been provided, that actively serves to induce the entrance of floating solid debris including leaves into the device, where such debris is readily received in a receptacle such as an open mesh bag 34. A suitable industrial grade plastic is preferably utilized in the construction of this novel debris skimmer, which plastic on the one hand possesses the attributes of being of light weight and inexpensive, yet on the other hand being sufficiently rigid and strong as to maintain its structural integrity throughout all conditions of use.

Although this invention is not to be limited to any certain range of sizes, one particular embodiment of this skimmer was approximately sixteen inches wide and fourteen inches long, with some sixteen holes, each 1/16 inch in diameter, being utilized in a spaced relationship across the front of the skimmer. This particular embodiment utilized a mesh bag approximately sixteen inches wide and twenty inches long, attached to the receptacle-receiving means of the skimmer by the use of an elastic or a draw string arrangement.

This skimmer device functions in an obviously effective and entirely automatic manner, requiring little attention and almost no maintenance expense, making it much more highly desirable than the passive devices of the prior art, which encounter and remove leaves from the surface of a pool only on a chance or happenstance basis.

Turning now to a further aspect of this invention, we have found it desirable in many instances to utilize an arrangement for modulating or controlling the amount of recirculated water permitted to pass to the novel skimmer device, and in FIGS. 10 through 17 we show significant details of such an arrangement.

Figure 10:
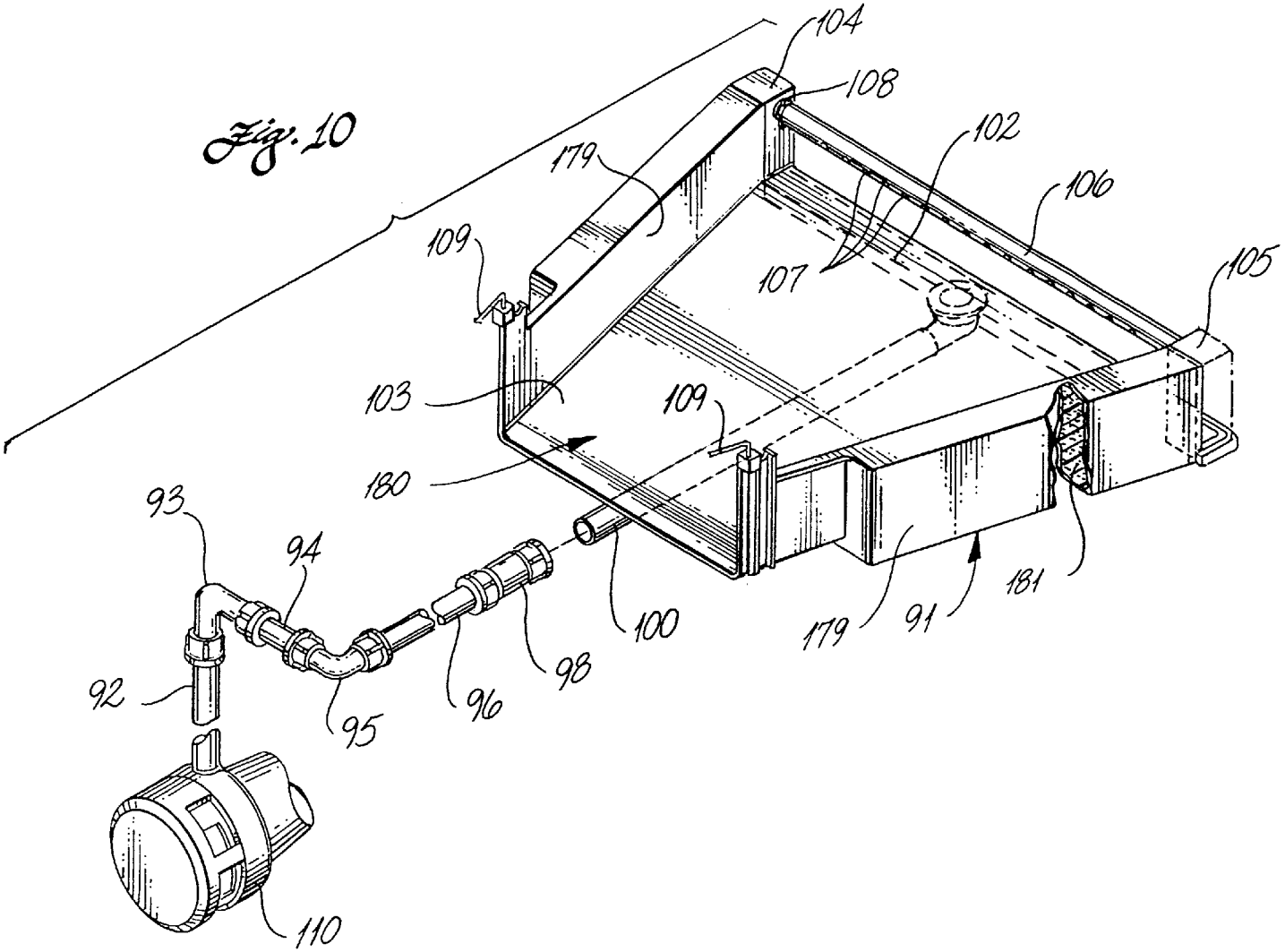
FIG. 10 is a perspective view of the novel pool skimmer of this invention, shown in conjunction with the particular components utilized in one instance for supplying water to the underside, and thereafter the spray bar of the skimmer.

With reference to FIG. 10, we show certain significant portions of the connections concerned with delivering the filtered water from the circulation pump of the pool to the skimmer 91, and it will be noted that in this embodiment, the flexible hose 48 has been replaced with a series of interconnected plastic pipes, preferably plastic pipes of a distinct configuration, yet having a degree of flexibility, with interconnecting fittings used at various locations. Utilized in conjunction with the organization illustrated in FIG. 10 is a spring loaded, flow-regulating and diverting valve assembly, which is discussed in conjunction with FIGS. 14 through 17.

It will be noted that in FIG. 10, we have shown the valve assembly 110 in approximately a typical relationship to a pool and to a skimmer floating on the surface of the pool, with FIG. 14, discussed hereinafter, revealing that a portion of the valve body 112 may be threadedly installed in a suitable fitting 46 operatively located on the sidewall of the pool.

In FIG. 10 it will be seen that a vertically disposed pipe 92 extends upwardly from the valve 110, with an elbow 93 utilized at the upper end of the pipe 92, in order to change the direction of the flow of the water being delivered to the skimmer. Connected to the elbow 93 may be a horizontally disposed pipe leading directly to the skimmer, but in the illustrated instance, the elbow 93 is connected to a relatively short, horizontally disposed pipe 94. The pipe 94 is in turn connected to elbow 95, with the elbow 95 being connected to another horizontally disposed pipe 96. It is to be noted in each instance we prefer to utilize conventional couplings which include plastic nuts that are internally threaded for coaction with the pipe in cooperation with hollow sleeves inside the pipe for securing the end of one component to the next component in a tightly fitting, leakproof manner.

It is usually desirable to utilize a swivel connection in the line used to deliver the recirculated water to the skimmer, for such arrangement makes it possible for the skimmer to move so as to conform to any wave action that may be occurring in the pool. To this end, we utilize a swivel member 98 connected, for example, between the pipe 96 and the inlet end of a horizontally disposed pipe 100 which is carried by skimmer 91 and which leads directly to an appropriate fitting located on the underside of the skimmer.

It was earlier pointed out that the skimmer may utilize a manifold residing close to the surface of the pool, as was illustrated in some detail in FIGS. 4 and 5, or the skimmer may utilize an elevated manifold of the type illustrated in FIGS. 8 and 9. In either instance, the pipe 100 is connected to deliver the recirculated water to an appropriate location on the particular skimmer embodiment used.

In the embodiment of the skimmer illustrated in FIG. 10, pipe 100 extends under the skimmer along its longitudinal centerline and is connected to a transverse supply duct 102 which preferably is integral with the underside of the skimmer body substantially along the forward edge of the skimmer floway. Supply duct 102 is in turn connected to a distribution header 104 on one side of the front of the skimmer, and to distribution header 105 located on the other side of the front of the skimmer. Each end of a tubular, open-ended spray jet manifold 106, having numerous aligned holes 107, is connected to a respective one of the distribution headers, so in this manner we are assured of an ample water supply to the manifold 106.

It is preferred that the spray bar or manifold 106 be removably mounted between headers 104 and 105. To that end, the spray bar makes a snug, water-tight interference fit at its opposite ends in coaxially aligned apertures formed in the upper portions of the opposing walls of the headers. The spray bar is rotatable, but not readily so, in those apertures for adjustment of the angular position of the spray bar relative to the skimmer floway, and it also is slidable in those apertures so that it can be removed for cleaning should that be useful. Normally, however, the spray bar is secured from axial movement between the headers by the cooperation, adjacent the header walls, of resilient plastic snap rings 108 with circumferential recesses in the exterior of the spray bar. The snap rings lie closely adjacent to the header walls and are removable from the spray bar to enable the bar to be removed for cleaning. This arrangement makes it possible for the user to change the angular relationship of the holes 107 to the surface of the skimmer floway, thus enabling the direction of the reaction force of water jets emerging from the spray bar to be readily controlled. This may become a matter of some importance when the trim of the skimmer, as it floats on the surface of the pool, is in need of some adjustment to establish a desired degree of submergence of the front edge of the floway bottom surface 103.

Figure 11:
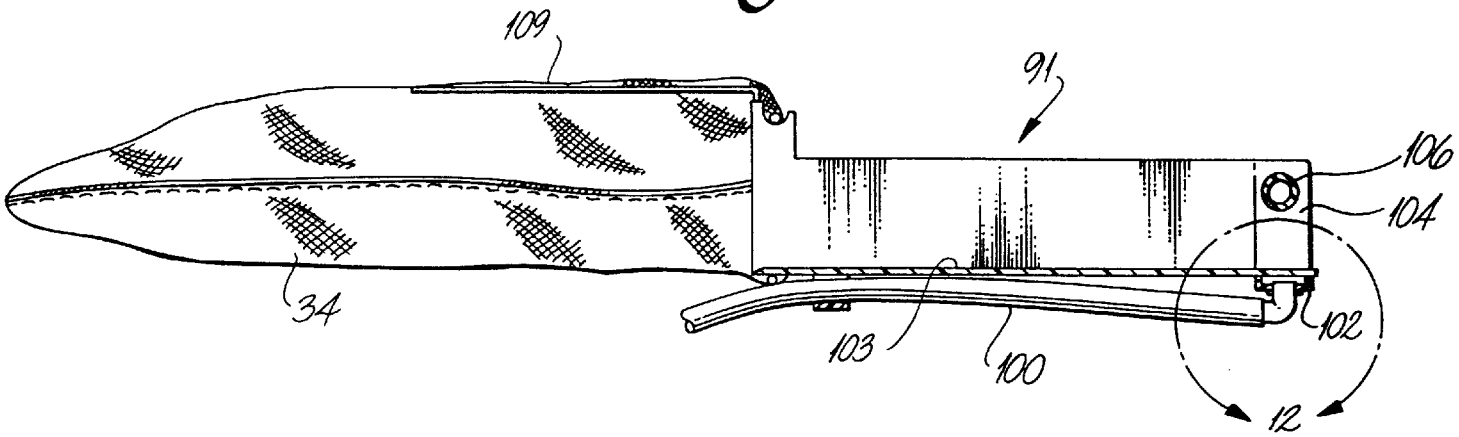
FIG. 11 is a side view, partly in section, showing the relationship of the supply pipe to the underside of the skimmer, and also revealing the use of a wire for holding the debris-receiving bag in an optimum position for receiving leaves and other floating items.

It is also to be seen in FIGS. 10 and 11 that we may utilize a generally U-shaped wire 109 on the upper aft end of the skimmer, which wire functions to hold open the entry portion of the leaf collection bag 34, so as to assure an easy and unobstructed entrance for solid debris into the bag.

Figure 12:
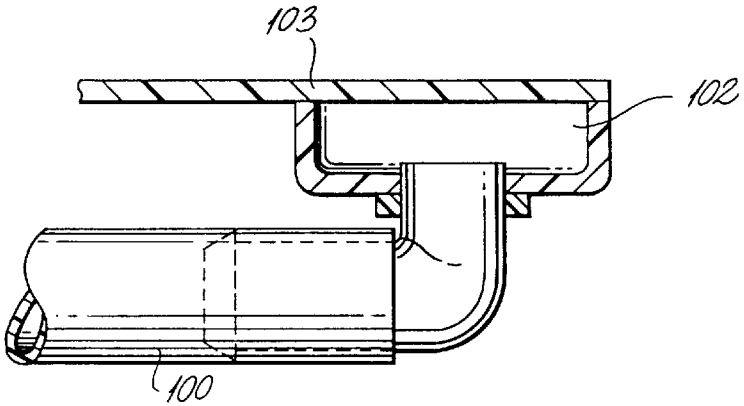
FIG. 12 is a fragmentary view to a somewhat larger scale, partly in section to reveal certain details of the supply duct utilized on the underside of the skimmer of FIG. 11.

In FIG. 11 we show a typical relationship of the pipe 100 to the underside of the skimmer of FIG. 10, and in FIG. 12, we show a typical cross-section of the duct 102.

Figure 13:
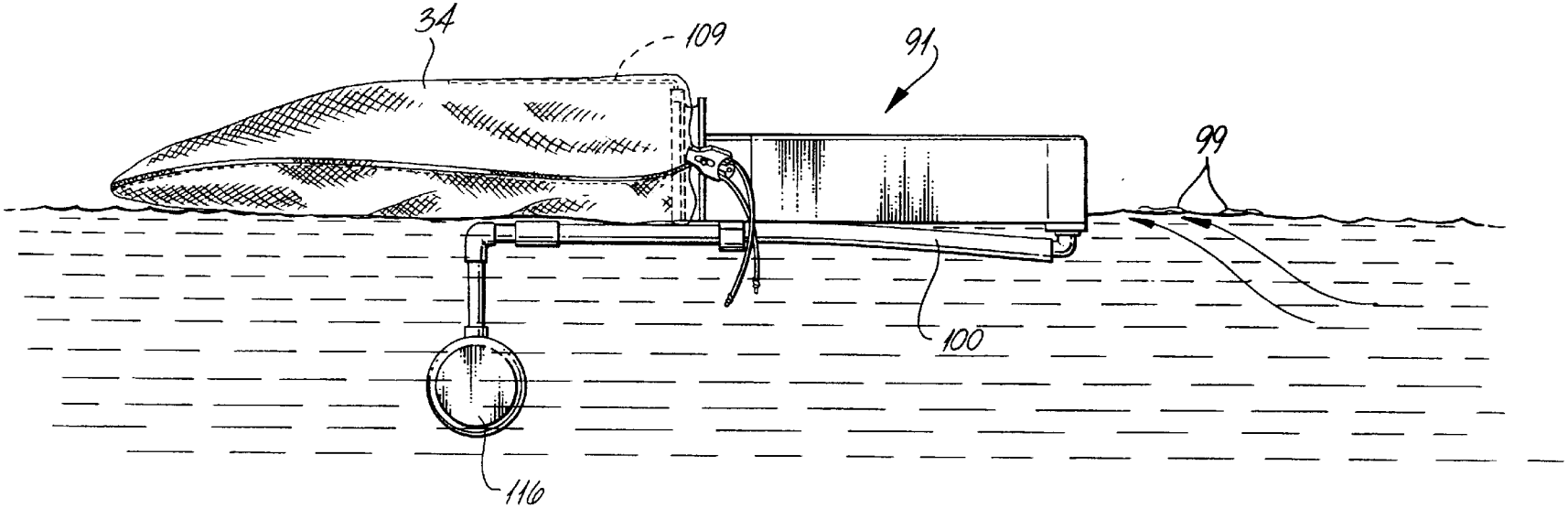
FIG. 13 is a side view generally along the lines of FIG. 11, but in this instance revealing the use of a lacing arrangement for holding the debris-receiving bag to the skimmer.

In FIG. 13, we illustrate an arrangement in which a draw string or lacing arrangement may be used to secure the debris-receiving bag 34 to the skimmer in an easily removable manner, and we also show in this figure some typical leaves 99 floating on the surface of the pool, about to be drawn into the skimmer inlet as a result of the action of the jets of water emanating from the spray bar.

As shown in FIG. 10, the converging, preferably vertical side walls 179 of flow-way 180 are hollow along most of their length rearwardly from headers 104 and 105. While the hollow interiors of walls 179 preferably are watertight, it is preferred that each of those spaces be filled with a lightweight, closed cell foam material 181. Those spaces form buoyancy chambers in the skimmer, which chambers are so defined in volume and location relative to the center of mass of the skimmer that, when afloat in a pool and with the spray bar 106 angularly oriented so that the jets of water from spray openings 107 are directed to about the midlength of the floway bottom surface 103, the skimmer floats during use with the front edge of the preferably flat floway bottom surface slightly below the rear edge of that surface. Adjustments in the operating trim of the skimmer can be made by rotating the spray bar in one direction or the other. The foam material 181 in the skimmer side walls prevents significant water entry into the buoyancy chambers should they cease to be watertight.

Figure 14:
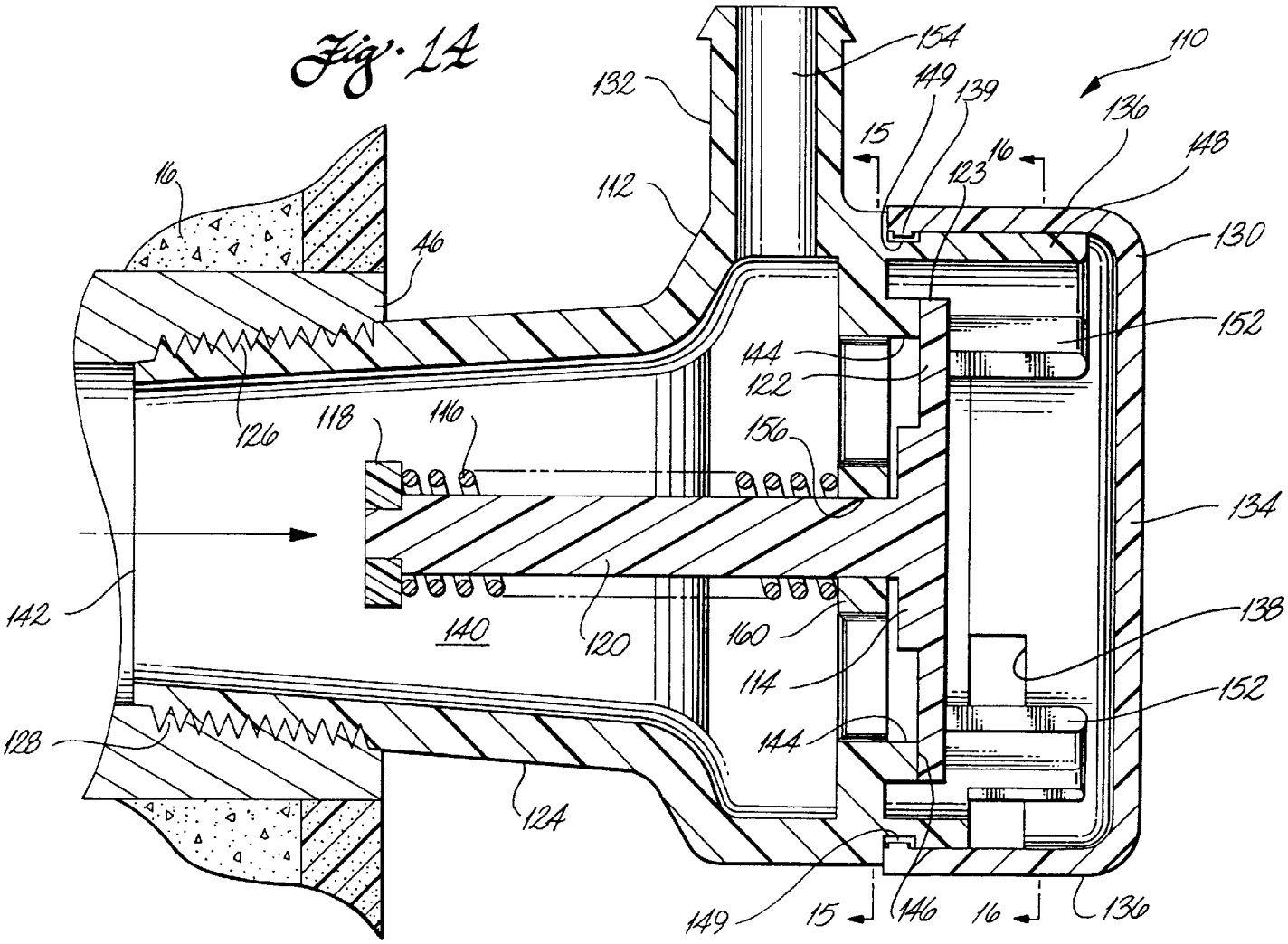
FIG. 14 is a longitudinal cross-sectional elevation view to a large scale of a preferred form of diverter valve for use in assuring an optimum flow rate of return water through the skimmer, and showing that the rotatable end cap can be selectively oriented by the user in order to cause a preferred direction of circulation of water through the pool.

Regarding FIG. 14, it will be seen that the valve assembly 110 comprises a body 112, a slidably mounted valve member 114, and a spring 116 for biasing the valve member 114 to its closed position. A spring retainer 118 serves to maintain the spring 116 in an operative relationship on the stem 120 of the normally-closed valve 114, causing the circular valve disk 122 to be biased into closure contact with the annular valve seat surface 146. As clearly visible in FIG. 14, the valve stem 120 extends coaxially from one side of the valve disc 122.

The valve body 112 is preferably fabricated by an injection molding process, and is generally of tubular configuration. The valve body has a generally cylindrical, modestly tapering inlet barrel 124, which is externally threaded, as at 126. The threads 126 cooperate with internal threads 128 formed in the earlier mentioned fitting 46 provided on the pool sidewall 16 at the time the pool was being constructed. The fitting 46 may be regarded as part of a pool water return line. An arrow in the inlet end of the inlet barrel 124 indicates the direction of flow of the water into the valve body.

On the end of the valve body 112 opposite the threaded portion 126 is a rotationally adjustable cap 130, provided for a purpose to be described shortly. Extending from a mid portion of the valve body is a nipple 132 associated with the delivery of water from the valve body to a skimmer such as skimmer 91. The nipple is preferably formed integral with the valve body 112 during the injection molding process.

As mentioned earlier, the return line forms a passage through which water flowing under pressure from a pool circulation pump is discharged into the pool 14. The pool includes at least one return line, but to be noted is the fact that is common for many swimming pools, particularly permanent in-ground concrete pools, to have two circulation pump return lines. These return lines discharge water into the pool at spaced locations in the pool wall, at an elevation in the pool which is approximately 7 inches below the mean water level of the pool 14.

The inlet barrel 124 of valve body 112 forms a chamber 140 which extends from inlet end 142 of the barrel to valved outlet port 144 located adjacent the opposite end of the valve body. Valve seat 146 is associated with port 144. A skimmer water supply passage 154 extends laterally from chamber 140 through the previously mentioned nipple 132.

The nipple 132 defines a structure by which the skimmer 91, e.g., can be connected to the valve assembly 110 by the use of the skimmer water supply duct represented by components 92–100 as shown in FIG. 10. The pressure of water flowing through skimmer supply passage 154 is at or below a maximum pressure which is determined by the characteristics of spring 116 which, as explained hereinafter, determines a pressure, within an appropriate range of pressure, at which the circular valve disk 122 unseats from a closure relationship to valve outlet port 144.

With regard to further constructional details of the valve member 114, it principally comprises the previously mentioned elongate, cylindrically shaped stem 120 rigidly attached to a central portion of one side of the circular valve disc 122. At a location closely adjacent the valve disc 122, the stem 120 is slidably journalled in a circular opening 156 through the central hub 160 of a so-called spider 162.

Figure 15:
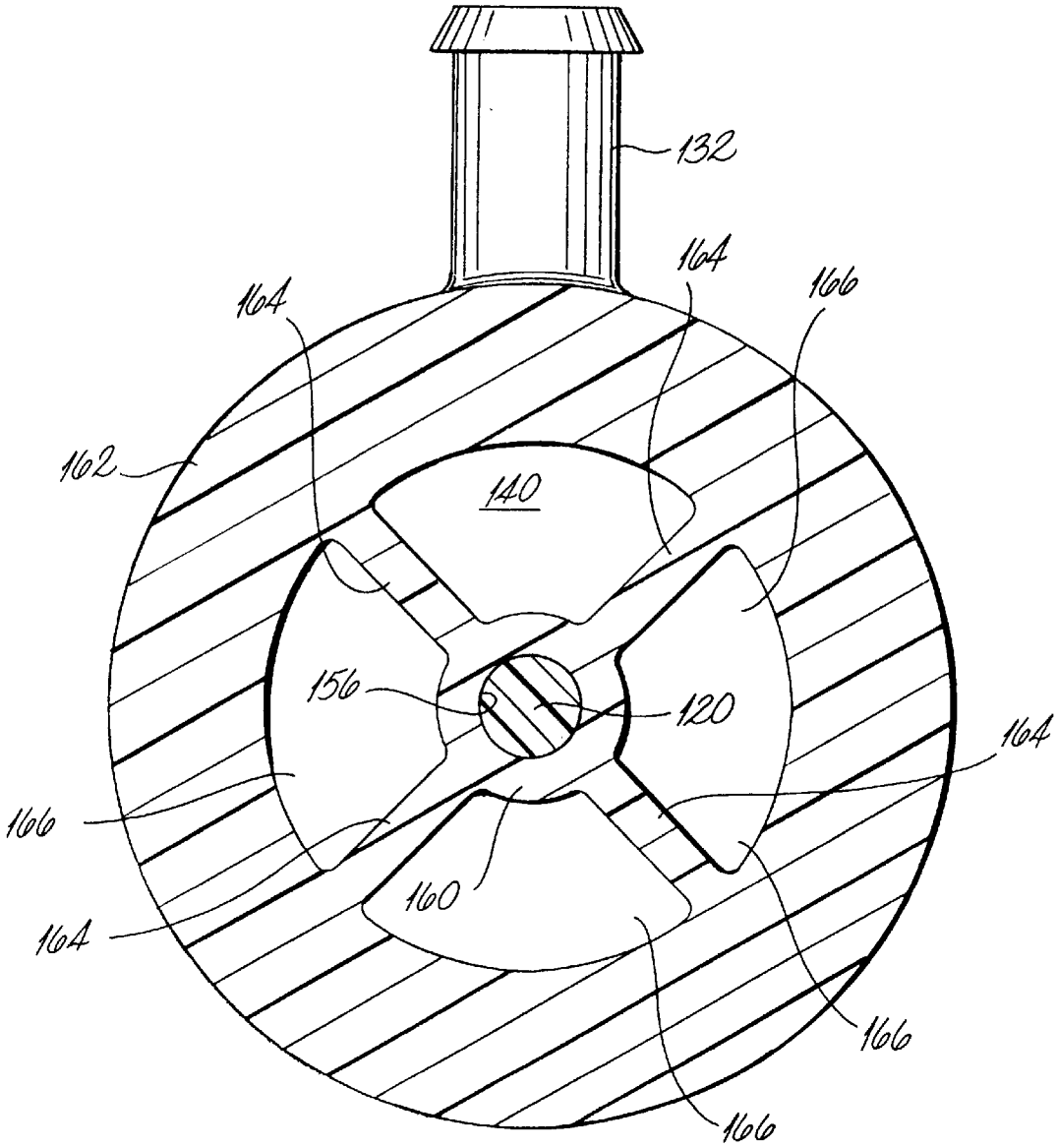
FIG. 15 is a cross-sectional view taken along lines 15—15 in FIG. 14, to reveal the spider arrangement utilized for supporting the spring biased valve.

As best seen in FIG. 15, the spider 162 is disposed across chamber 140 closely adjacent annular valve seat surface 146 which surrounds valve port 144 and which lies in a plane perpendicular to the longitudinal centerline of the valve body 112. Hub 160 is supported in the valve body by a plurality of spaced radially extending arms 164 visible in this figure. The arms 164 and the hub 160 are preferably formed integrally with the remainder of the valve body 112. FIG. 15 reveals that the spacing of the arms 164 results in there being a plurality of openings 166 within the valve body between the arms 164, so that water in chamber 140 can flow through those openings to the valve port 144 and from the valve assembly when, in response to a buildup of water pressure in the chamber 140, the force of spring 116 is overcome, and the valve disk 122 moves away from valve seat 146.

As previously mentioned, the spring 116 is disposed about the valve stem 120 and is compressed between the spring retainer ring 118, affixed to the end of the valve stem near the valve body inlet 142, and the adjacent face of hub 160 which supports the stem 120 of the valve member 114 in body 112. This detail is best seen in FIG. 14. The dimensions of the valve member 114 and of the valve body are defined in cooperation with the characteristics of spring 116 so that the spring holds the valve member 114 in closed relation to valve outlet port 144 until water pressure in chamber 140 equals or exceeds a predetermined pressure. That predetermined pressure is typically approximately 4 psig. which is the preferred pressure at which water is supplied through nipple 132 to the skimmer 91, which is revealed in FIG. 10 to float adjacent the valve assembly 110 on the surface of pool 14. We are, of course, not to be limited to the use of a spring causing a flow of water past the valve disc 122 when the water pressure exceeds 4 psig. Also revealed in FIG. 14 is rotatably mounted cap 130, which cooperates with the discharge end of valve body 112 in an adjustable manner for controlling the direction in which water flowing past the open valve disk 122 enters pool 14. The cap 130 is operably associated with circularly disposed, generally cylindrically shaped body outlet sleeve 148. The outlet sleeve 148 is integral with the valve body 112 and extends axially of the valve body concentrically about the valve outlet port 144.

Figure 16:
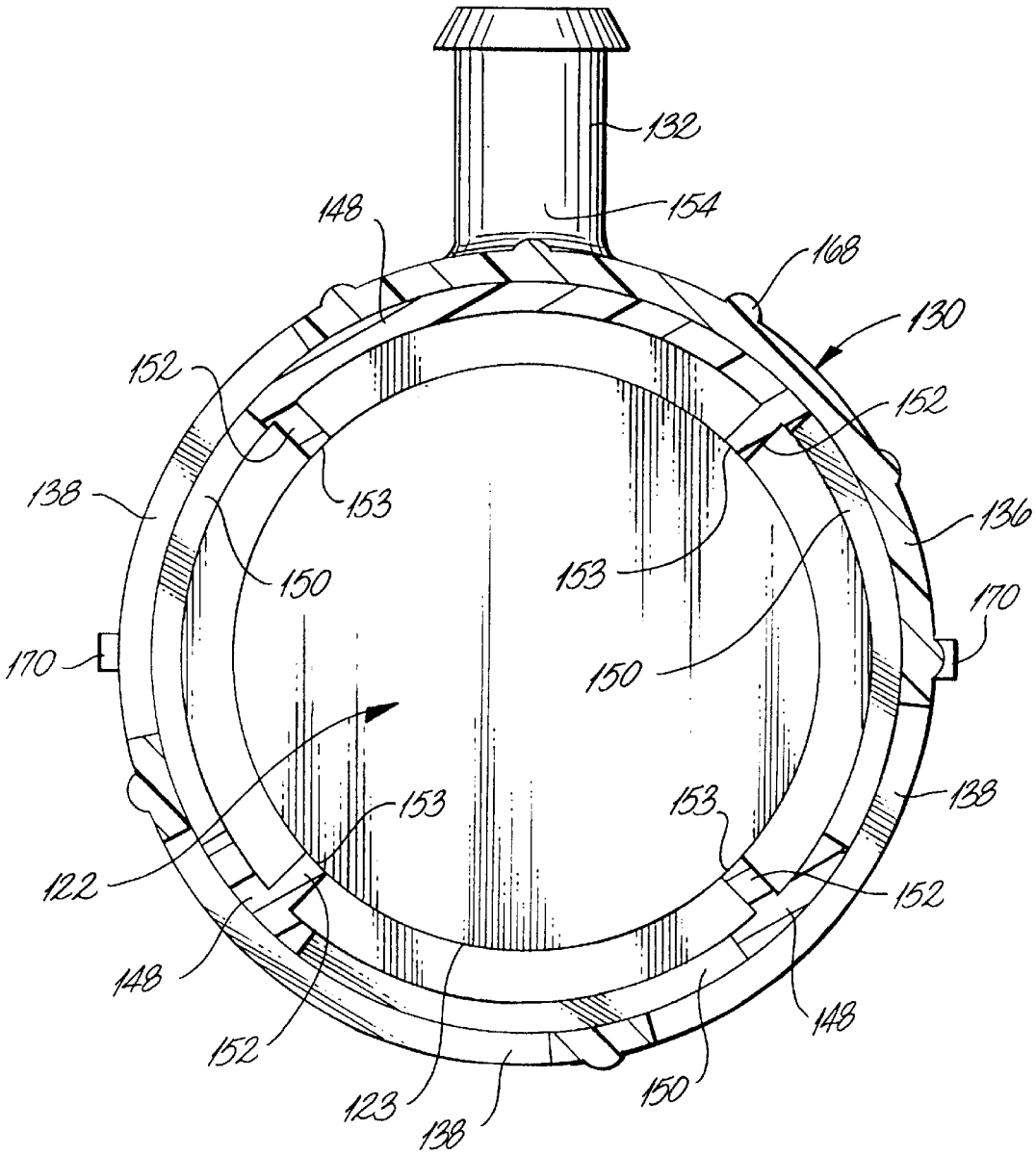
FIG. 16 is a cross-sectional view taken along lines 16—16 in FIG. 14, to reveal the relationship of apertures in the selectively rotatable cap with apertures provided in a sleeve member of the valve body.

As shown best in FIG. 16, portions of body outlet sleeve 148 are cut away to define a plurality of circumferentially disposed openings 150 extending radially outwardly from the interior of sleeve 148. At suitably spaced locations around the interior of sleeve 148, projections 152 extend radially inwardly from the sleeve 148 to ends 153. The ends 153 cooperate slidably with the perimeter 123 of valve disk 122, for guiding the valve disk as the valve opens and closes in response to variations in water pressure in chamber 140.

Returning to a further consideration of the cap 130, it has a main, substantially flat wall 134, and extending for a substantial portion around the perimeter of the cap 130 are integral, circumferentially extending walls 136. The walls 136 are disposed in a surrounding, slidable relationship to the outer surfaces of the outlet sleeve 148, and inasmuch as these walls are generally of cylindrical configuration, the walls 136 may be regarded as the sleeve portion of the cap. As shown in FIGS. 14 and 16, the sleeve portion 136 of cap 130 is cut away at selected locations to define a plurality of openings 138, the positions of which can be selectively changed with respect to the openings 150 of the body outlet sleeve 148 by the rotation of the cap 130 with respect to the outlet sleeve.

Cap 130 is captive on the body outlet sleeve through cooperation of a shallow circumferentially-extending rib 139, which extends inwardly of the sleeve portion 136 of the cap near its open end and which cooperates in an annular groove 149 formed in the exterior surface of valve body sleeve 148.

Except for spring 116, it is preferred that all components of valve assembly 110 be manufactured by injection molding processes. The valve assembly is assembled by inserting the stem 120 of the valve member through the opening 156 in hub 160, placing the spring 116 around the stem, and affixing spring retainer ring 118 to the rear (inlet) end of the valve stem as by threading, but more preferably by a suitable bonding process such as solvent or sonic bonding. Cap 130 is snapped into place on the valve body over sleeve 148 so that it is rotatable on the body in the manner described above.

Figure 17:
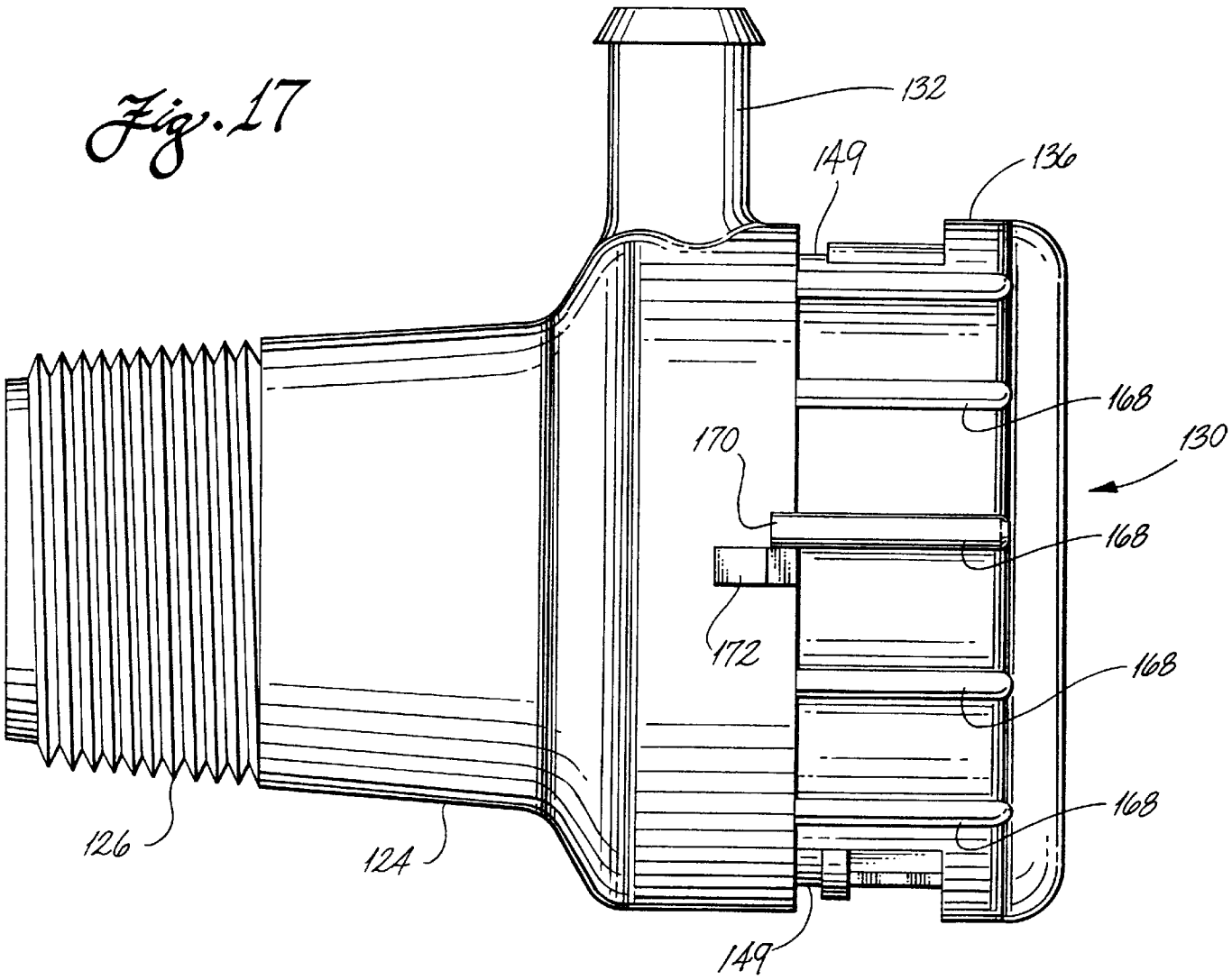
FIG. 17 is an exterior view of a preferred embodiment of a diverter valve, revealing a stop means utilized for limiting the amount of rotation of the cap that can be made by the user.

As shown in FIG. 17, in a presently preferred cap 130, a plurality of shallow ribs 168 are raised from the outer walls of the sleeve portion 136 and extend parallel to the axis about which the cap is rotatable. One rib, rib 170, extends somewhat beyond the open end of the cap, as shown in FIG. 17. Rib extension 170 cooperates with diametrically opposed projections 172 formed on the outer surface of the valve body just rearwardly of the transverse plane of the valve body in which recess 174 is formed. Cap rib extension 170 cooperates with valve body projections 172 to provide stops (limits) for the angular positioning of the cap 130 on the valve body. Thus, when the rib extension 170 cooperates with one of the valve body projections, the direction of water discharge from the valve assembly will be laterally from the side of the valve assembly which is opposite from that side where the rib extension cooperates with the body projection 172. The valve assembly preferably is installed in fitting 46 so nipple 132 extends substantially upwardly (vertically) from the valve body. Thus, lateral discharge of water from the valve assembly is the same as horizontal discharge in one direction or the other.

The user can selectively rotate the cap through an arc of about 180° between the stops 172 so that the direction of water discharge from the valve assembly can be adjusted to be left or right from the valve assembly, depending on the desired direction of circulation of the water about the pool. The direction of discharge from the cap can also be downwardly, if that should be desired.

As shown best in FIG. 16, cap sleeve portion 136 is continuous through an arc of about 120° around the cap circumference, but is otherwise substantially open as a consequence of the plurality of openings 138 located in the sleeve portion. Also, body outlet sleeve 148 is continuously solid or closed through an arc of about 90° at the upper portion of the valve body, but is otherwise open through about 270° of the circumference of the valve body, as a consequence of the presence of openings 150.

Particularly in a swimming pool system having a single return line to the pool from the circulation pump, as a consequence of the sizing of the pump and its drive motor, the mass flowrate and pressure of water in the return line can significantly exceed the flowrate and pressure requirements of a skimmer according to this invention; the same can be true, but usually to a lesser extent, for each of the return lines in a pool system having two return line connections to the pool. Persons familiar with the operation and maintenance of swimming pools and their machinery readily will recognize that, over time, the flowrate and pressure of pool return line water can decrease significantly between service events at the pool filter, i.e., replacement or backflushing of the filter medium. Therefore, merely supplying a fixed proportion of overall return line flow to a skimmer as described above is not satisfactory over a period of any significant length; as return line flow decreases, the rate and pressure of water flow to the skimmer also decreases, so that the performance of the skimmer also decreases.

It is to be understood that the valve assembly routes to the skimmer 10 via passage 154 in the nipple 132, only that amount of water which is necessary for good operation of the skimmer, and the water which is presented to the skimmer is at a pressure which corresponds to good operation of the skimmer. That water amount and pressure is substantially constant over a wide range of water flowrates through the return line or lines of the pool.

As should now be clear, that the further (balance) portion of the return line flow which is not used to operate the skimmer causes the valve member 114 to open so that such water bypasses the skimmer supply passage 154 and enters the pool to create a desired water circulation pattern in the pool. Significantly, by selective rotation of the cap 130, the user can cause the water which bypasses passage 154 and which enters the pool to establish or to contribute to a pool circulation pattern which moves solid debris on the pool surface toward the skimmer, where the skimmer operates to collect such debris in bag 34.

It should now be apparent that the present novel skimmer is powered by water under pressure emanating from a source remote from the skimmer, and thus does not require that any electric power be supplied to the skimmer. That is in stark contrast to skimmer devices that are unusable without a supply to them of electrical power of a preascertained voltage.

What is claimed is:

1. An active debris collector, floatable on the surface of a swimming pool having a return line to the pool from a pool water circulation pump, for gathering solid debris floating on the pool surface, the collector comprising a body floatable on the surface of a swimming pool, a foraminous debris collection receptacle releasably connectable to a rear end of the body, and a water supply conduit connectable between a swimming pool return line and the body for supplying water under pressure to the body and for positioning the body on the pool surface, the body defining a shallow floway from an inlet thereto at a front end of the body to a discharge therefrom at the rear end of the body, the floway having a substantially smooth and horizontal bottom surface substantially continuously therealong, duct means carried by the body to which the conduit is connectable and defining adjacent the floway inlet at least one discharge opening oriented to discharge water into and along the floway toward the discharge therefrom and to create a water current effective to draw into the floway solid debris floating adjacent thereto on a pool surface and to move the same toward and past the floway discharge, the conduit including a resiliently biased pressure regulating and flow diverting valve assembly mountable to a discharge end of a return line, the valve assembly operating over and in response to a range of return line flow conditions to supply water at a controlled rate to the body and to direct to the pool return line water flow in excess of that controlled rate.

2. A debris collector according to claim 1 wherein the valve assembly includes means for controlling the direction in which water is directed to the pool from the valve assembly.

3. An active water-surface skimmer floatable on the surface of a body of water at an essentially fixed desired location on the water surface and powered essentially only by pressurized water supplied to the skimmer from a remote source via a conduit which serves in part to define the desired location, the skimmer comprising a floatable buoyant body having a front end and a rear end and defining a shallow floway having an inlet and an outlet at the body front and rear ends respectively, the body defining a substantially flat floway bottom surface which extends smoothly and continuously between the floway inlet and outlet and is laterally bounded along its extent by upstanding walls defined by the body, closed cell foam material in the floway walls, the body being floatable in the water body with the floway partially submerged below the water surface, a conduit connection on the body below the floway, a spray tube carried between the floway walls transversely above the floway bottom surface and defining a plurality of spray openings at aligned locations along a rear portion of the tube, water passages in the body extending between the conduit connection and the spray tube, and a mesh bag removably connectible at an open end thereof to the body around the floway outlet.

4. A skimmer according to claim 3 in which the spray tube is angularly adjustable about its length relative to the body.

5. A skimmer according to claim 3 including a vertical flange on the body at each side of the floway outlet and extending laterally away from the outlet, the flanges cooperating with the bag at its open end for connecting the bag to the body.

6. A skimmer according to claim 3 including a bag support member connectible to the body at the top of the floway outlet.

7. A skimmer according to claim 6 in which the bag support member is a length of wire connectible at its ends to the body and formed between its ends in a U-configuration, the wire extending into and supporting the top of the bag when both the bag and the wire are connected to the body.

8. A skimmer according to claim 3 in which the conduit connection is located proximate the floway inlet, and including a conduit holder carried on a bottom surface of the body adjacent the floway outlet.

9. A skimmer according to claim 3 in which the bag includes a drawstring in association with its open end.

10. A debris skimmer designed to float adjacent the surface of the water of a pool at a substantially stationary location in the pool, and to actively entrap floating solid debris, including leaves, said skimmer having an upper surface along which a floway is defined, said floway having a front and a rear, an entrance lip at said front, and a perforate, easily emptied receptacle designed to capture and retain solid debris mountable to the rear of the floway, said floway being defined by a substantially smooth and horizontal surface extending continuously from the front to the rear and bounded by an upwardly contoured member on each side, and a water manifold extending from side to side in an elevated position above the entrance lip and defining a plurality of rearwardly-directed jets of water and serving by said jets to move solid debris floating adjacent the floway front end rearwardly over said surface toward the rear of the floway.

11. A debris skimmer designed to float adjacent the surface of the water of a pool at a substantially stationary location in the pool, and to actively entrap floating solid debris, including leaves, said skimmer having an upper and a rear, an entrance lip at said front, and a perforate, easily emptied receptacle designed to capture and retain solid debris mountable to the rear of the floway, said floway being defined by a substantially smooth and horizontal surface extending continuously from the front to the rear and bounded by an upwardly contoured member on each side, a water manifold in the vicinity of said entrance lip defining a plurality of rearwardly-directed jets of water and serving by said jets to move solid debris floating adjacent the floway front end rearwardly over said surface toward the rear of the floway, and a pressure responsive flow regulating valve operably disposed in a conduit for supplying water under pressure to said water manifold, said valve being connectable to the discharge opening of a return line from a pump in a water circulation system for the pool and operative to prevent too great a flow of water through said water manifold.

12. An active debris collector, floatable on the surface of a pool having a return line to the pool from a pool water circulation pump, for gathering solid debris floating on the pool surface, the collector comprising a body floatable on the surface of a pool, a foraminous debris collection receptacle releasably connectable to a rear end of the body, and a water supply conduit connectable between a pool return line and the body for supplying water under pressure to the body and for positioning the body on the pool surface, the body defining a shallow essentially flat-bottomed floway from an inlet thereto at a front end of the body to a discharge therefrom at the rear end of the body, duct means carried by the body to which the conduit is connectable and defining adjacent the floway inlet a plurality of discharge openings oriented to discharge water into and along the floway toward the discharge therefrom and to create a water current effective to draw into the floway solid debris floating adjacent thereto on a pool surface and to move the same toward and past the floway discharge, the conduit including a valve mechanism for limiting the pressure of an initial portion of return line water supplied to the body to a pressure within a selected range of pressures and for passing to the pool such further portion of the return line water as would otherwise cause water in the conduit to be at a pressure above said range, the valve mechanism being operable in response to return line flow conditions to supply to the collector duct means water at substantially a selected pressure throughout a range of water flow conditions in the return line.

13. The debris skimmer as recited in claim 10 in which said water manifold is angularly adjustable in the body to enable a user to control the angularity of such water jets with respect to the surface of the water in the pool.

14. The debris skimmer as recited in claim 11 in which said pressure regulating valve has a spring biased valve member arranged to open at the time the water pressure exceeds a certain value, thus to bypass excess return line water flow the pool.

* * * * *